United States Patent [19]

Gooding

[11] 4,164,316

[45] Aug. 14, 1979

[54] FOLDABLE DISPLAY CONTAINER

[76] Inventor: David O. Gooding, 199 Gregory Blvd., East Norwalk, Conn. 06855

[21] Appl. No.: 843,837

[22] Filed: Oct. 20, 1977

[51] Int. Cl.[2] ..... B65D 5/36

[52] U.S. Cl. ..... 229/41 R; 211/132; 248/174

[58] Field of Search ..... 229/41 C, 41 R, 41 B; 211/132, 126; 312/258, 45; 206/44 B; 248/174

[56] References Cited

U.S. PATENT DOCUMENTS

| | | | |
|---|---|---|---|
| 1,545,771 | 7/1925 | Hout | 248/174 UX |
| 1,548,237 | 8/1925 | Ackerman | 229/41 R |
| 1,576,672 | 3/1926 | Miller | 248/174 |
| 1,911,073 | 5/1933 | Dyment | 229/41 C X |
| 2,271,962 | 2/1942 | Weiner | 229/41 R |
| 2,283,406 | 5/1942 | Bacon | 229/41 R X |
| 2,290,144 | 7/1942 | Katz | 229/41 R X |
| 2,317,884 | 4/1943 | Clouston | 229/23 A X |
| 2,326,648 | 8/1943 | Horr | 229/41 B X |
| 3,565,325 | 2/1971 | Pugsley | 229/41 B X |
| 3,756,497 | 9/1973 | Stewart | 229/22 |

FOREIGN PATENT DOCUMENTS

| | | | |
|---|---|---|---|
| 12544 | of 1906 | United Kingdom | 248/174 |

*Primary Examiner*—Davis T. Moorhead
*Attorney, Agent, or Firm*—Peter L. Berger

[57] ABSTRACT

This invention relates to foldable display containers, and more particularly, to such foldable display containers which are inexpensive and convenient to use.

7 Claims, 5 Drawing Figures

FIG.1
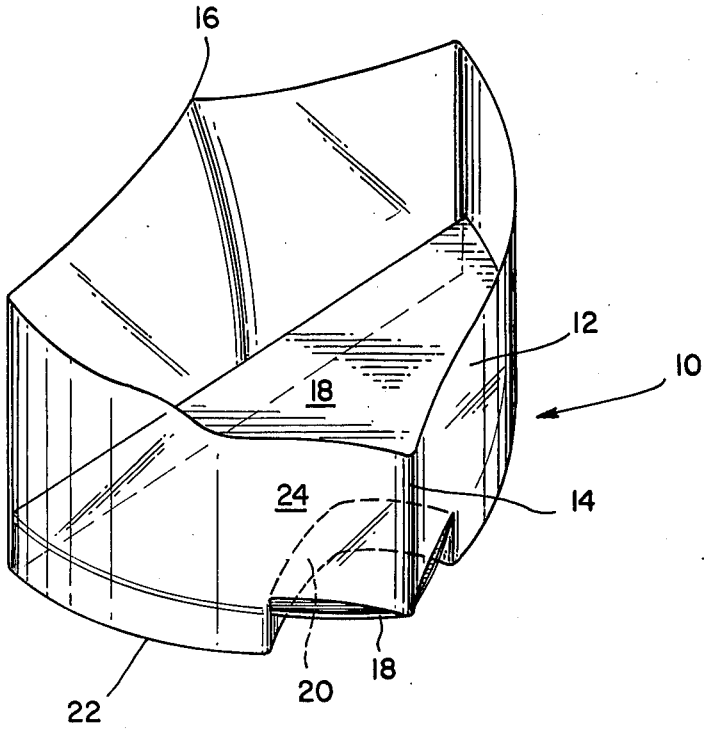
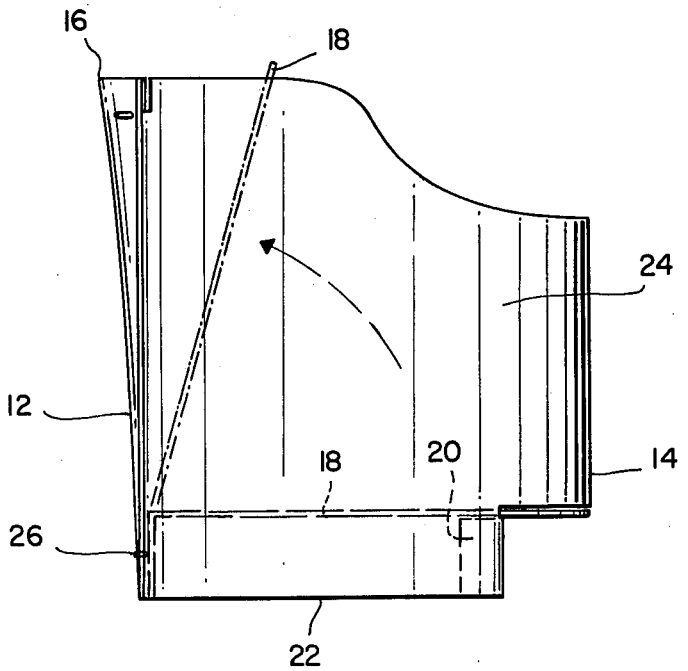
FIG.2

FIG.3
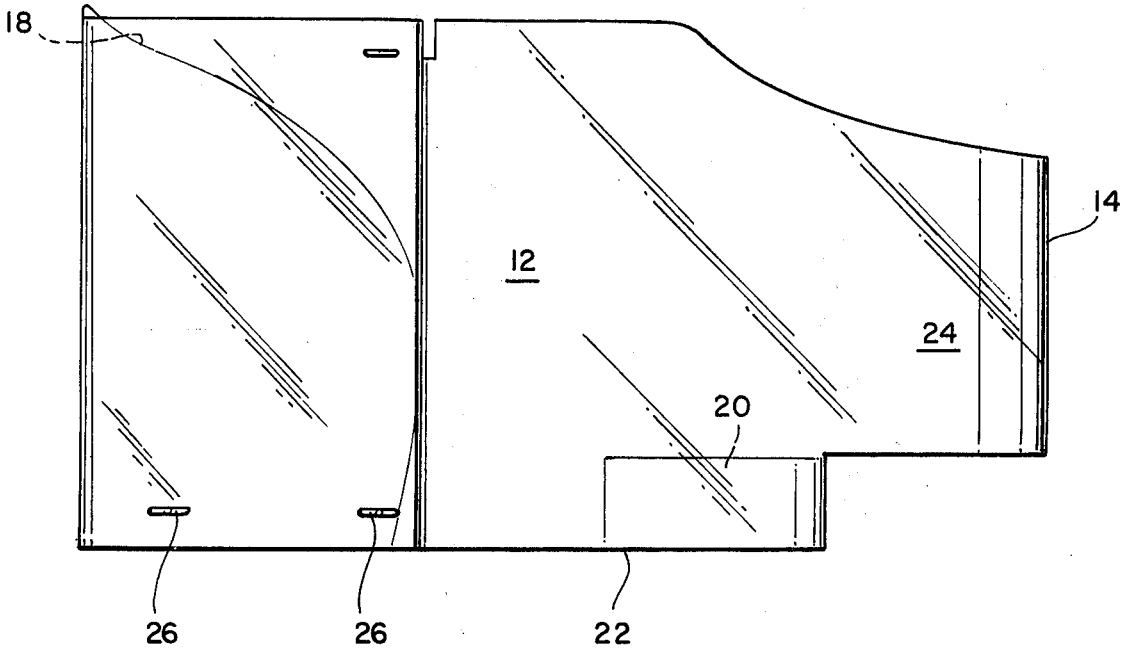
FIG.4
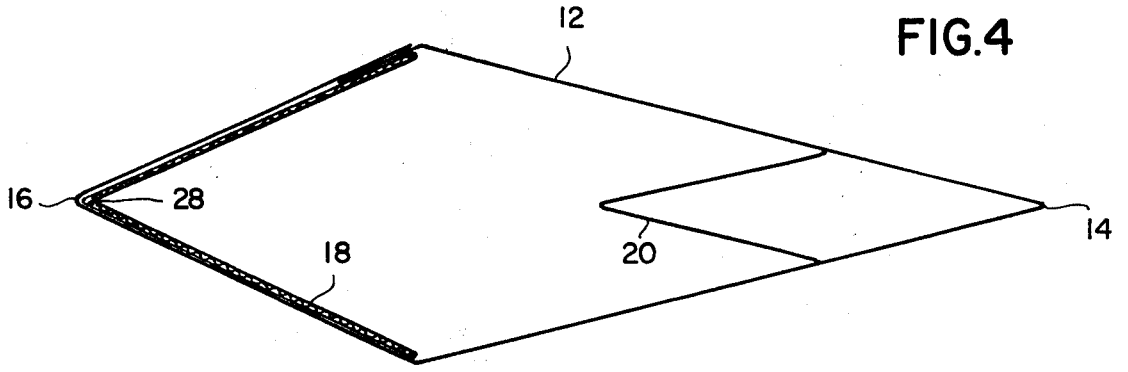
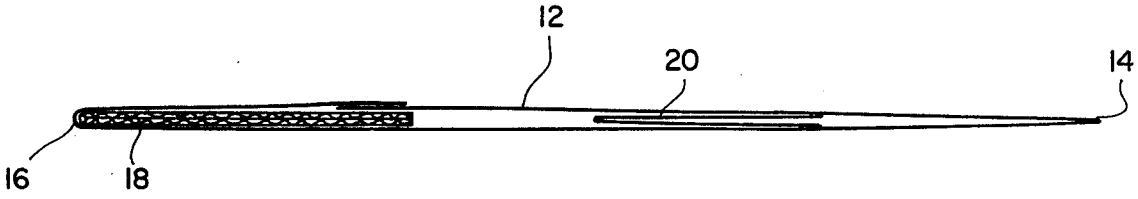
FIG.5

FOLDABLE DISPLAY CONTAINER

BACKGROUND OF THE INVENTION

Display containers are widely utilized for displaying merchandise to be purchased. These display containers take on many shapes, sizes and forms, and there is a class of such containers which are adapted to sit on top of a check-out counter, permitting easy viewing of the contents while the purchaser is paying for goods. These display containers are also used for displaying small-sized articles such as chewing gum, candy, and the like and are placed in an easily viewable area.

Such display containers are often constructed of materials which are expensive. Additionally, these displays have a short shelf life and require frequent replacement. The construction of prior art containers are such that the shipping and handling of them is cumbersome requiring complicated set up techniques and often requiring substantial time for arranging the display container.

An object of this invention is to provide a display container which is capable of being easily shipped, stored and utilized.

Another object of this invention is to provide such a display container which is inexpensive and may easily be disposed of.

Still another object of this invention is to provide such a display container which clearly displays the contents thereof for ready access by potential purchasers.

Another object of this invention is to provide such a display container which folds flat for easy shipment and storage.

Yet another object of this invention is to provide a display container which provides sufficient structural support for the contents contained therein.

Another object of this invention is to provide such a display container which may be easily and quickly set up for use.

Still another object of this invention is to provide a display container which is attractive to use and conveniently carries the prominent trademark or logo of the product carried within the container.

Yet another object of this invention is to provide such container which has a large open top area permitting easy removal of the contents thereof.

Other objects, advantages and features of this invention will become more apparent from the following description.

BRIEF SUMMARY OF THE INVENTION

In accordance with the principles of this invention, the above objects are accomplished by providing a foldable display container which comprises a wall formed of a stiff, thin plastic sheet material, a base member hingedly connected to the wall comprising hinge means folding the base member upwardly within the wall for storage and downwardly to form a bottom of said container, said wall comprising pre-scored regions permitting said wall to fold substantially flat with the base member folded therewithin, said base member being folded downwardly to form said horizontal support base with the walls conforming to the shape of the base member, and support rib means integrally attached to the wall for the base member to rest thereon for the base member to be supported thereon and to form the bottom of the container.

Preferably the thin-plastic sheet material is clear so as to permit easy viewing of the contents thereof. As may be seen, the pre-scoring for the wall is arranged to conform with pre-scoring of the base so that the foldable container may be shipped and stored in a flat condition. This materially enhances the usability of such containers, since such shipment is relatively inexpensive as compared with prior art devices.

The base is formed of a cardboard material which is pre-scored to be biased hingedly upwardly, and when the container is set up for usage, the cardboard base is folded downwardly and is supported by a support rib integrally formed with the wall, the support rib being formed of a lower front portion of the wall separated from the remainder of the wall to extend across the front area of the base member thereunder. The bottom edge of the wall is flat so that the container may rest on a flat surface for easy viewability and display.

BRIEF DESCRIPTION OF THE DRAWINGS

FIG. 1 is a perspective view of the container of this invention.

FIG. 2 is a side view of the container of FIG. 1, showing the base being folded upwardly.

FIG. 3 is a side view of the container folded substantially flat.

FIG. 4 is a top view showing the base nesting within a pre-scored wall as the container is being folded flat.

FIG. 5 is an edge view showing the folded flat position of the container of my invention.

DETAILED DESCRIPTION OF THE INVENTION

Referring to FIG. 1, there is shown a perspective view of my foldable display container 10 which comprises a wall 12 formed of a stiff-thin clear plastic material with the wall being pre-scored along a front edge or region 14. The wall is formed of a single sheet of material. The back portion of the wall 12 is also pre-scored at a region 16.

The container is formed of said wall 12 and a base member 18, the base member being hingedly connected to the rear portion of wall 12 and being biased to fold upwardly. When the container is open as in FIG. 1, a support rib 20 is utilized for the base member to rest thereon, the support rib being formed of a lower front portion of the wall which is separated from the wall to extend across the front area under the base member for supporting the base member. The container illustrated in FIG. 1 has a footed bottom, and the bottom edge of the wall 22 is flat so as to enable the container to sit on a flat surface.

The front area 24 of the wall is adapted to receive printing or the like so that the trademark of the contents of the container may be attractively displayed. The container, when open, forms a large open top to permit easy removal of the contents thereof.

Referring to FIG. 2, there is shown the base 18 which is formed of a cardboard being folded upwardly, the base being connected to the wall 12 by staples 26 along the bottom edge of the rear of the wall.

As illustrated in FIGS. 3 through 5, the container is adapted to be stored in a flat condition, and the base 18 is pre-scored along a central region 28 so as to permit the base 18 to nest within the pre-scored wall region 16. In this fashion, the base folds flat within the wall 12 and permits easy storage and handling. The support rib 20 is formed of the lower front portion of the wall 12 and also folds and folds flat within the wall when the container is being arranged for shipment. The flat condition of the folded container is best illustrated in FIG. 5 with the wall being folded about the pre-scored regions 14 and 16 as described above.

As may be seen from FIG. 2, the depth of base 18 is approximately equal to the height of wall 12, so that the base 18 is substantially closed and sandwiched within the wall, when the wall is folded.

Referring again to FIG. 1, the base 18 is adapted to normally be biased to fold upwardly, and when folded down to form the open container position, the front edge of base 18 rests slightly below the lower front edge of the wall so as to form an additional support area which both prevents the base from flipping upwardly and provides additional structural support tension thereat. This occurs because the wall 12 formed of plastic material is sufficiently thin to flex back slightwardly in said front wall region beyond the projecting front edge of base 18. As may be seen the container takes the shape of the base, since the walls conform to the semi-circular base shape.

As may be seen, this invention provides a unique, simple and inexpensive foldable display container which may be widely utilized because of its low cost, simplicity of use and facility for shipping and handling. The foldable display container may be set up with a minimum of time and inconvenience and provides an attractive, rigid and easily accessible display container. Such container may be easily placed in check out counters or other areas so as to permit prospective purchasers to easily see the display contents and remove the contents from the container.

This invention has been described in detail with the above illustrated embodiments, but other forms of the invention may be easily arranged by those skilled in the art taking into account the teachings of this patent application.

What is claimed is:

1. A foldable display container containing small articles, said container adapted to sit on check-out type counters, said container comprising:

a wall formed of stiff thin plastic sheet material, a base member hingedly connected with said wall and comprising hinge means for folding said base member upwardly within said wall for storage and downwardly to form a bottom of said container, said wall comprising pre-scored regions permitting said wall to fold substantially flat with said base member folded therewithin, said base member being folded downwardly to form a horizontal support base with said wall conforming to the shape of said base member, support rib means integrally formed of said wall and formed in the lower front portion thereof being separable from the front wall to extend across the front area of said base member thereunder for the base member to rest thereon, whereby said small articles to be sold are placed in said display container, said wall and said support rib means comprising a uniform bottom edge to sit on a flat surface of said counter, and comprising biasing means for said base member to be biased upwardly at said hinge means, so that when opened said base member rests on said support bar and the upper surface of the front edge of the base member bears against the lower edge of the wall to form a rigid container area in which said small articles are placed.

2. A container as claimed in claim 1 wherein said plastic sheet material comprises clear plastic.

3. A container as claimed in claim 1 wherein said base is pre-scored along a central portion thereof, said base being attached to said wall such that said pre-scored base folds along said pre-scored portion and rests in a pre-scored region of said wall.

4. A container as claimed in claim 3, wherein the depth of said base is approximately equal to the height of said wall, such that said base is fitted within said wall.

5. A container as claimed in claim 1, wherein said base member comprises a substantially semi-circular shape, with the flat portion of said base being hingedly connected to said wall and the rounded portion of said base forming the shape for the walls of said container.

6. A container as claimed in claim 1, wherein said base member comprises cardboard stapled to said wall.

7. A container as claimed in claim 1, wherein said base member comprises cardboard stapled to said wall.

* * * * *